US007165503B2

(12) United States Patent
Mascellaro

(10) Patent No.: US 7,165,503 B2
(45) Date of Patent: Jan. 23, 2007

(54) HULL OF A SHIP HAVING A CENTRAL KEEL AND SIDE CHINES

(76) Inventor: Luigi Mascellaro, Via Fosso Della Castelluccia 146/22, I-00134 Rome (IT)

( * ) Notice: Subject to any disclaimer, the term of this patent is extended or adjusted under 35 U.S.C. 154(b) by 0 days.

(21) Appl. No.: 10/513,480

(22) PCT Filed: May 6, 2003

(86) PCT No.: PCT/IT03/00271

§ 371 (c)(1),
(2), (4) Date: Jul. 18, 2005

(87) PCT Pub. No.: WO03/095296

PCT Pub. Date: Nov. 20, 2003

(65) Prior Publication Data

US 2006/0060120 A1 Mar. 23, 2006

(30) Foreign Application Priority Data

May 8, 2002 (IT) ..... RM2002A0251

(51) Int. Cl.
*B63B 1/04* (2006.01)
*B63B 1/20* (2006.01)
*B63B 1/32* (2006.01)

(52) U.S. Cl. ..... 114/290; 114/56.1; 114/61.2; 114/61.32

(58) Field of Classification Search ..... 114/56.1, 114/61.1, 61.2, 61.27–61.33, 62, 63, 67 A, 114/288–291, 283; D12/304, 310–314
See application file for complete search history.

(56) References Cited

U.S. PATENT DOCUMENTS 3,702,598 A 11/1972 Szptyman
3,885,514 A 5/1975 Lauenborg
4,672,905 A * 6/1987 Pipkorn ..... 114/290
4,924,797 A 5/1990 Solia
5,402,743 A 4/1995 Holderman
6,112,687 A * 9/2000 Eder ..... 114/61.2
6,138,602 A 10/2000 Cary
6,345,584 B1 * 2/2002 Mascellaro ..... 114/290

FOREIGN PATENT DOCUMENTS

FR 2 295 868 7/1976
FR 2387840 A * 12/1978
FR 2 635 497 2/1990
WO WO 99/57006 11/1999

* cited by examiner

*Primary Examiner*—Ajay Vasudeva
(74) *Attorney, Agent, or Firm*—Young & Thompson

(57) ABSTRACT

A hull of a ship has a front hull part (10) with a deep V-shape contour having an angle gradually increasing from fore to aft to become 180 degrees in a rear hull part (14) with chines extending according to a side hull contour. The chines, starting from the stern, have a lower edge which is situated under the waterline (20) astern of the midship cross section and then raises such that they are radiused with the front hull part (10).

13 Claims, 4 Drawing Sheets

HULL OF A SHIP HAVING A CENTRAL KEEL AND SIDE CHINES

FIELD OF THE INVENTION

This invention relates to a hull of a ship having a central keel and side chines.

BACKGROUND OF THE INVENTION

The applicant is the owner of the Italian Patents Nos. 1299454 and 1306755, as well as of the corresponding Patent Application PCT/IT99/00101 filed on 11 Nov. 1999, entitled "Hull for shipping with a mono-three-catamaran architecture". Both previous patents and patent application disclose a parallel side hull having a pair of wing-contour chines, the lower edge of each chine beginning at a cross section plane near the bow under the waterline. Forward the hull has a central keel extending for a length less than the distance between the bow cross section and the midship cross section. The bottom of the hull between said chines, and between each chine and said central keel, where the keel is present, has convex bottom structures defining inverted longitudinal channels.

An object of the above mentioned hull is to convey the bow wave system into the bottom thereof and then to recover a portion of the energy spent in the wave system formation in order to increase the hydrodynamic sustentation of the hull.

However, this object is achieved only when the speed of the ship is very low, e.g. in barges or similar ships. When the speed increases, the angle formed by the bow wave system is reduced with respect to the situation in which the forward motion speed is low. With a high speed, the very forwarded chines are useless in conveying that wave system. Further, in the hull according to the previous applicant's patents the beam cross section is too great and positioned too forward with respect to the length of the ship. If one considers this fact together with the high extension of the chines which are fully submerged nearly to the bow, he comprises that the wetted surface is large, and as a result the resistance to forward motion is high.

Another drawback of the prior art, which is connected to the high extension of the fully submerged chines, is in general a highly difficult manoeuvrability of the ship.

Further, in the applicant's mono-three-catamaran hull, an increase of the speed would cause an excessive hydrodynamic thrust onto the bow. Such an excessive thrust would not be sufficiently counterbalanced aft by a pressure in said channel acting as a nozzle, even if this pressure is increased by enlarging the channel between the spaced apart chines and raising the bottom to the stern. Thus, the trim of the ship would not be kept constant, as, on the contrary, it is made provision by another object of the patents and patent application above cited.

Furthermore, another previous drawback is a poor ability of a hull to correct automatically its list as the mono-three-catamaran architecture acts as a supported beam without an accentuated righting moment.

Therefore, an object of the present invention is to overcome the above mentioned drawbacks which are met above all when the speed of a ship increases.

An object of the present invention is to provide a hull adapted to ships having a speed greater than that one allowed by the above mentioned hull.

An object of the invention is to provide a hull having an architecture with reduced resistance to the forward motion.

Another object of the invention is to provide a hull without a change in trimming at the cruising speeds.

Further, an object of the invention is to provide a hull having such a slender construction to be readily manoeuvred.

Furthermore, an object of the invention is to provide a hull having an improved ability to correct automatically its list.

DISCLOSURE OF THE INVENTION

Therefore, the invention according to claim 1 provides a hull of a ship having a central keel and side chines, in which a midship cross section on the waterline divides the hull in a front hull part, including a central keel, and a rear hull part, having sides provided with chines with a determined maximum depth and extending according to a side hull contour, a rear hull part bottom which gradually raises from the central keel aft toward the waterline, whereby said front hull part has a deep V-shape contour, with the central keel extending in aft direction gradually downward to a depth greater than said maximum depth of the chines and finally raising in aft direction, the V-shape of the contour of the front hull part having an angle between the chines gradually increasing from fore to aft to become 180 degrees; said chines, starting from the stern, have a lower edge which is situated under the waterline astern of the midship cross section and then radiused with the front hull part.

BRIEF DESCRIPTION OF THE DRAWINGS

The present invention will now be described with reference to a preferred embodiment thereof and the accompanying drawings, in which.

DETAILED DESCRIPTION OF THE PREFERRED EMBODIMENT

Figure 1:
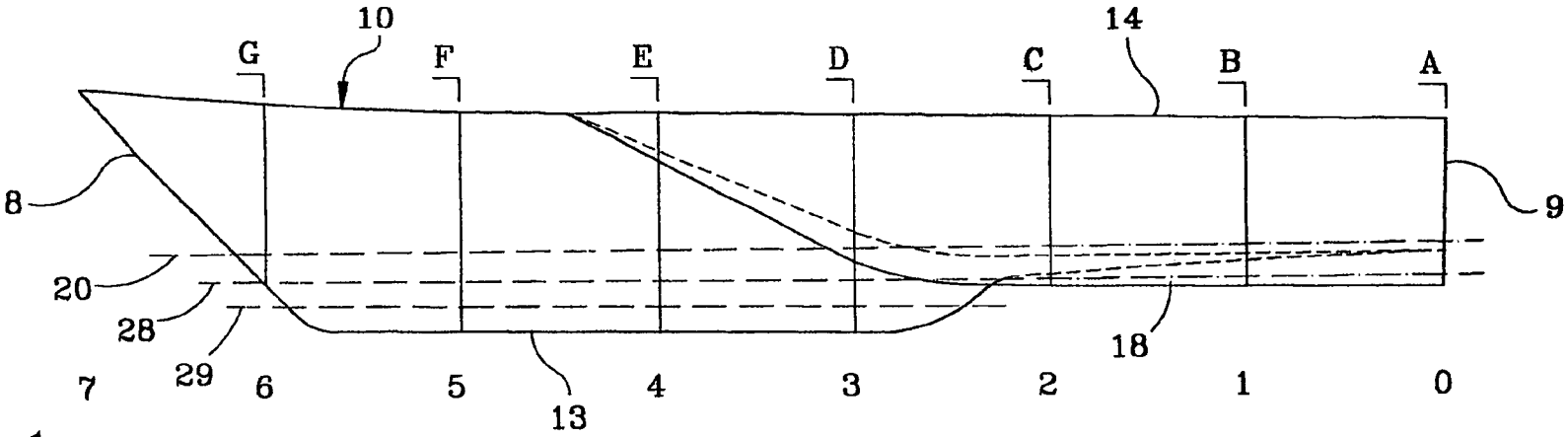
FIG. 1 is a side view of an embodiment of a hull of a ship according to the invention.
Figure 2:
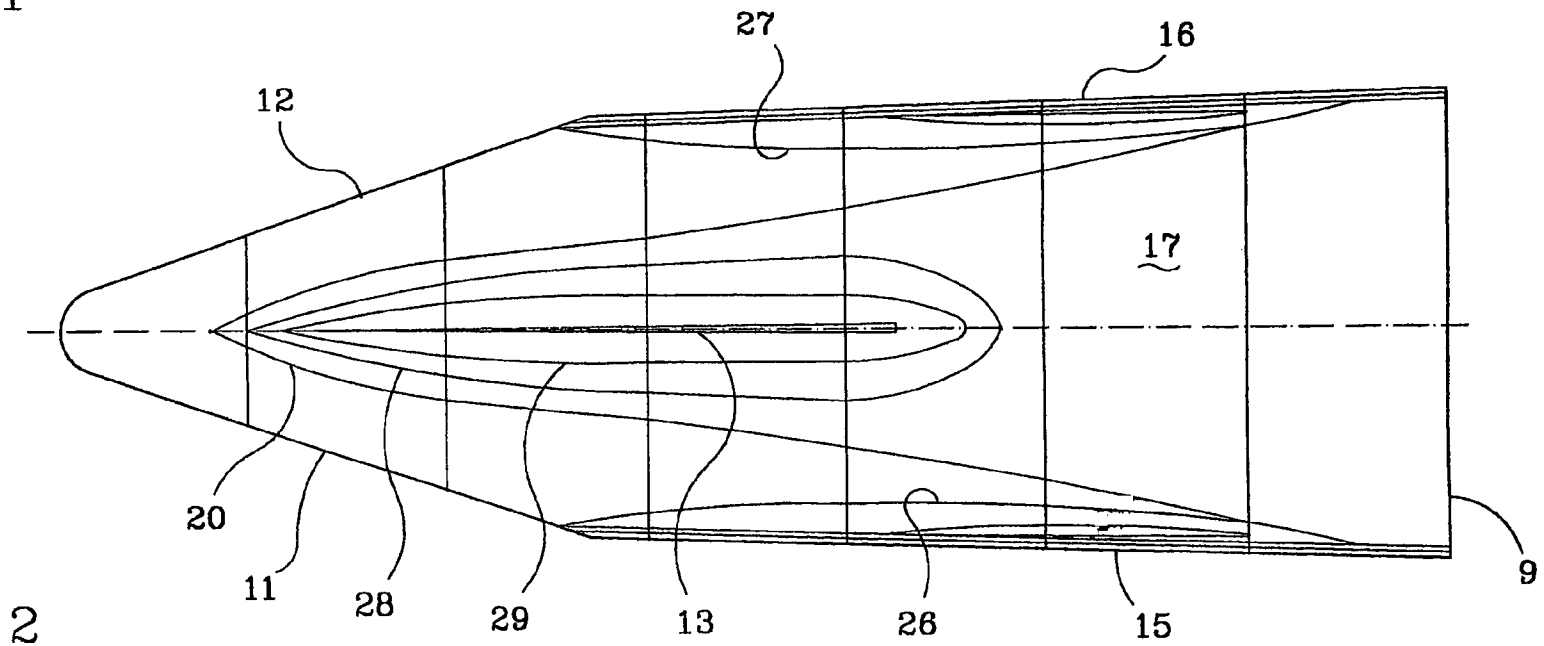
FIG. 2 is a bottom view of the same hull of FIG. 1, showing in particular the keel and chine structure as well as the waterlines thereof.

First reference is made to FIGS. 1 and 2, showing, with respect to seven numbered stations, a side view of the hull and a bottom view with waterlines, respectively.

Broadly speaking, the hull can be considered with respect to a midship cross section taken in the middle length on the waterline. The waterline is indicated as 20. The midship cross section is nearly in the station 3 and divides a front hull part 10, which is substantially a mono hull, extending with sides 11, 12 and keel 13, from a rear hull part 14, extending with sides 15, 16, a bottom 17 and chines 18 and 19.

Figure 3:
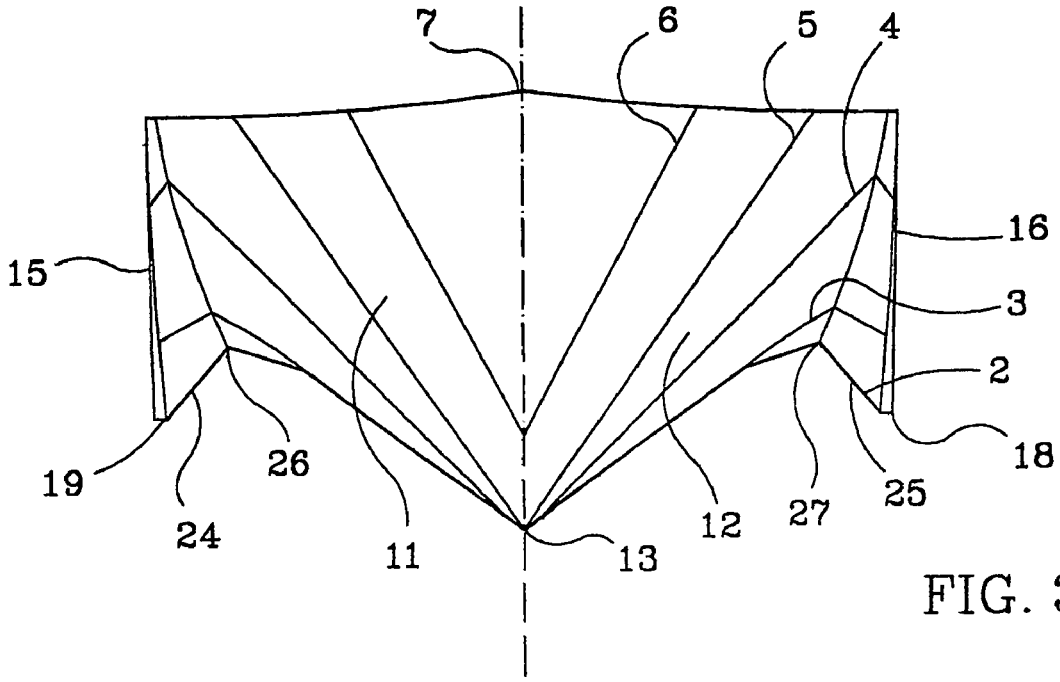
FIG. 3 is a front view of the embodiment of the hull, showing its contours in seven stations, the last two rear ones of which cannot be seen.

The chines 18 and 19 are portions connecting the sides 15 and 16, respectively, to the bottom 17 (FIG. 3).

Figure 4:
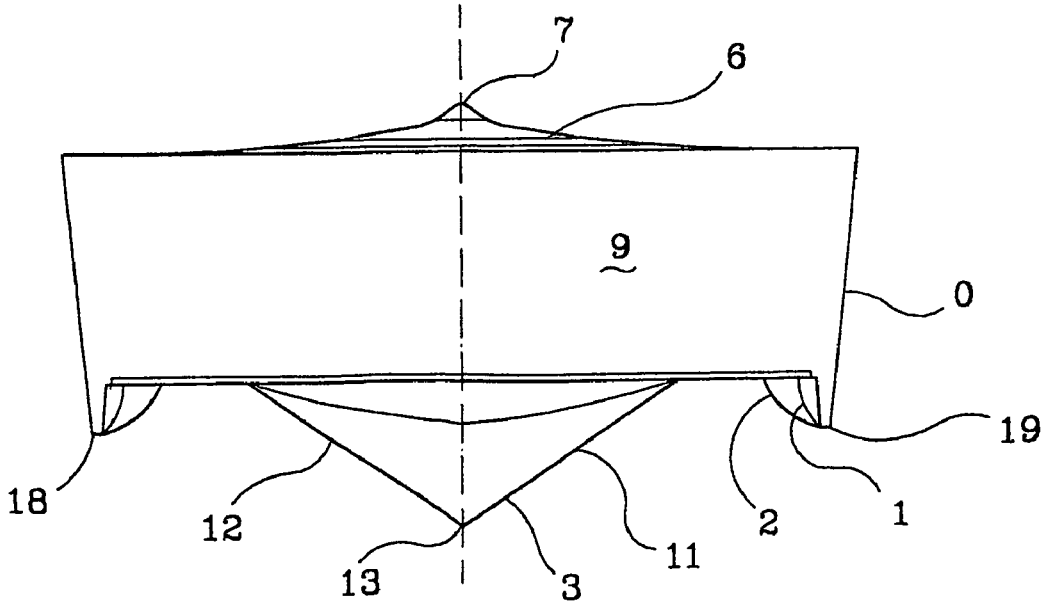
FIG. 4 is a rear view of the same hull showing generally contours in the rear stations.
Figure 5A:
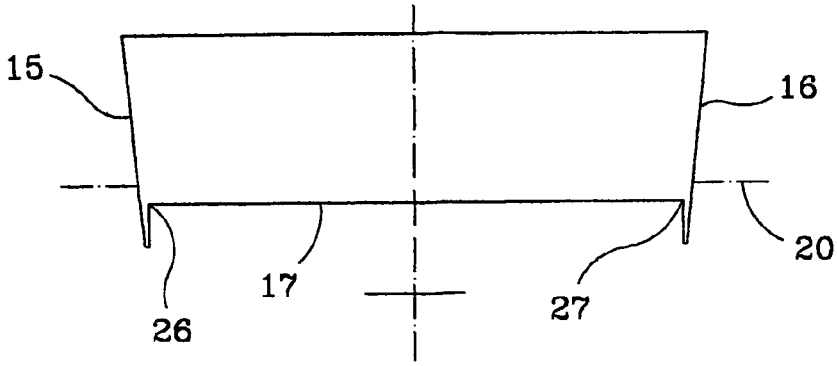
FIGS. 5A, 5B, 5C, 5D, 5E, 5F, 5G are cross sectional views of the hull taken along lines A—A, B—B, C—C, D—D, E—E, F—F, and G—G in FIGS. 1 and 2.
Figure 5B:
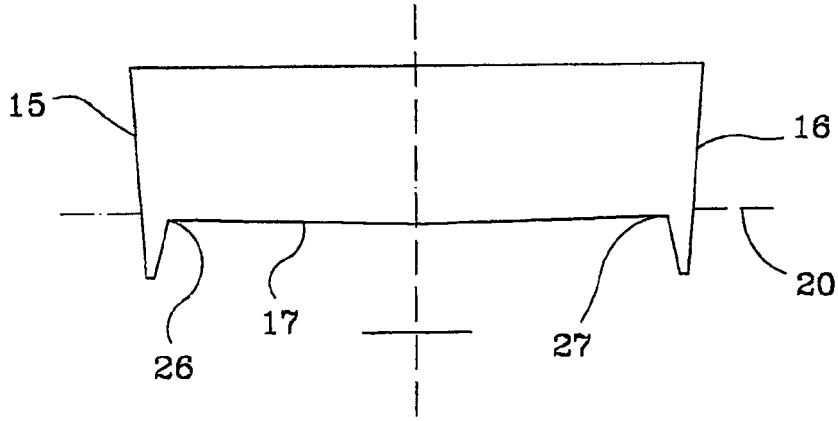
Figure 5C:
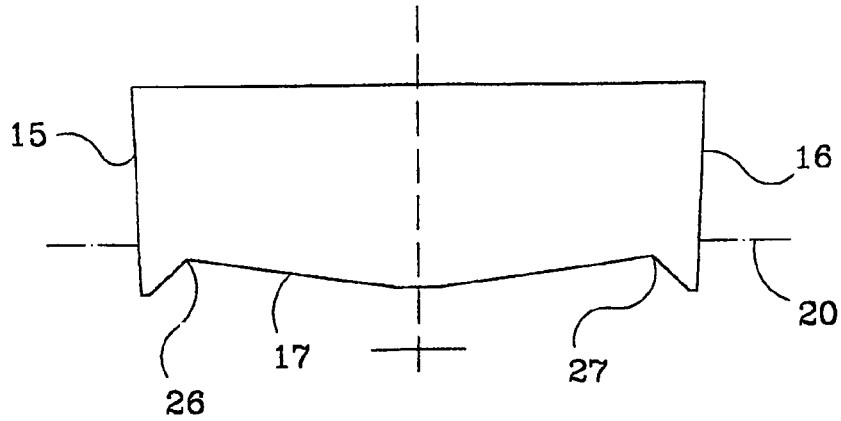
Figure 5D:
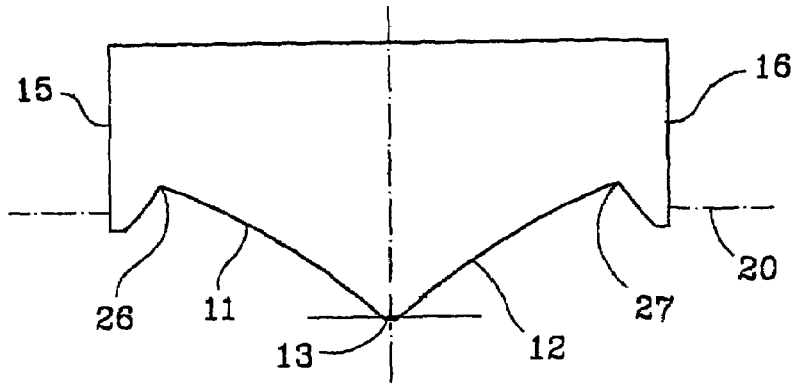
Figure 5E:
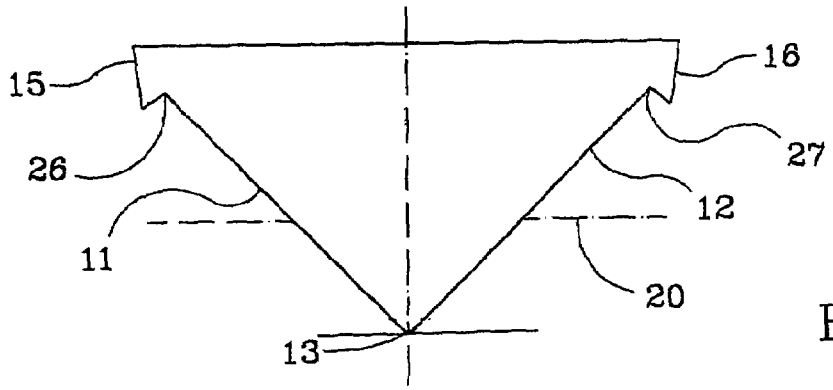
Figure 5F:
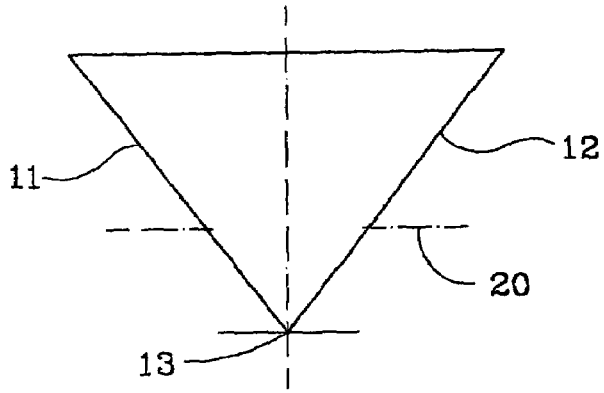
Figure 5G:
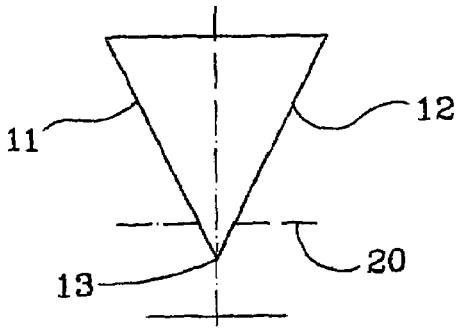

As from the following description, the front part 10 is connected uniformly in its contour to the rear part 14. This can be appreciated also through FIGS. 3, 4, which are a front view and a rear view, respectively, of the hull, and FIGS. 5A to 5G, showing hull contours in various cross sections.

The front hull part 10 has sides 11, 12 forming a V-shape with the keel 13. Fore and aft, i.e. from FIG. 5G to 5A, a hull angle, that is the angle between the sides 11 and 12, increases to become a straight angle near the stem. While this keel is shown to have concave and/or convex contours, however said contours can be flat. In this case the hull can be manufactured easily also from a metal plate.

Again fore and aft, the keel 13, which is radiused to a stem 8, keeps its maximum depth in the front hull part 10 going astern of the midship cross section. Preferably, this maximum depth is constant for an easy manufacture.

The keel 13 raises aft remaining slightly under the waterline 20 when the ship is stationary, in a transom 9.

In FIG. 2 the line 20 is relevant to the waterline 20 and other waterlines, such as 28 and 29, are obtained by section planes with path 28 and 29 in FIG. 1.

In the superior portion of the hull, as the hull angle increases fore and aft, the sides of the front hull part are divergent to merge into the rear part 14, preferably fore the midship cross section 3, in particular ahead of the cross section 4. In this point the chines 18, 19 also begin and radiuse the sides 15, 16 with the bottom 17.

The chines 18, 19 are not directly connected to the bottom 17, but through respective small inner counter-sides 24, 25, which are slanting upward to a intersection line 26, 27.

It should be evident that the front part including the keel 13, by moving the water in the forward motion of the hull, is a functional portion of the hull. As a typical working of the hull of every ship not classified among the so-called "gliding" ones, energy is transmitted to the water. The transmission of this energy, for clarity sake, is performed in a wave system that can be considered only in a bow crest and then in a trough, or depression, and next raising again. In the embodiment according to the invention the raising is astern of the midship cross section, preferably in the flat bottom zone, for the cruising speed of said ship. In this point the kinetic energy of the water, in virtue of the nozzle-shaped bottom of the hull, is returned in the form of pressure energy. This pressure energy is used to keep the hull in a desired trim, always connected to the cruising speed.

As a result of foregoing, the hull has an ability to correct its list in virtue of a volume distribution. The righting effect can be increased by a ballast when applied to rescue boats or by a stub or leeboard in a sail boat.

In the embodiment shown the sides 15 and 16 of the rear hull part 14 are substantially parallel. However, they can be divergent from the bottom to deck. In alternative, the sides, instead being substantially vertical, can be tapered downward taken in direction fore to aft.

There are various advantages from a V-shaped keel. The wave formed around the keel is received optimally by the chines being back with respect to the prior art without any reduction in the foamy formation, which is essential for breaking the laminar boundary layer.

Advantageously, for increasing the diffusing effect of the hull, the sides of the rear hull part can be divergent however depending on design choice and purpose of use of ship, considering that it is critical to allow the continuation of the flow rate under the hull.

The chines begin in general near the midship, thereby the front hull part and the rear hull part constitute two masses having high separated moments of inertia. As a consequence of a high inclination about a longitudinal axis or roll, a central fall at bow occurs in virtue of the great mass of the front hull part.

Also with an exaggerate list, a little more than 90°, the reserve of buoyancy of the submerged chine would allow a rotation downward of the front hull part, and a consequent stabilization.

Advantageously, the edges of the chines begin under the waterline in order to convey more easily a further amount of air in addition to that one determined by the bow wave system.

Advantageously, a hull without curved portions is easily manufactured in all-metal construction, i.e. a hull having shapes as right as possible. It is evident that, from a constructive point of view, it can be suitable to have convex shapes by using other materials, e.g. fiberglass-reinforced plastic.

The invention claimed is:

1. A hull of a ship having a central keel and side chines, in which a midship cross section on the waterline divides the hull in a front hull part, including a central keel, and a rear hull part, having sides provided with chines with a determined maximum depth and extending according to a side hull contour, a rear hull part bottom which gradually raises from the central keel aft toward the waterline, characterized in that:

said front hull part has a deep V-shape contour, with the central keel extending in aft direction gradually downward to a depth greater than said maximum depth of the chines and finally raising in aft direction, the V-shape of the contour of the front hull part having an angle between the chines gradually increasing from fore to aft to become 180 degrees;

said chines, starting from the stern, have a lower edge which is situated under the waterline astern of the midship cross section and then radiused with the front hull part.

2. A hull according to claim 1, characterized in that the central keel raises upward astern of the midship cross section.

3. A hull according to claim 1, characterized in that said sides of the rear hull part are divergent from the bottom to deck.

4. A hull according to claim 1, characterized in that said sides of the rear hull part are vertical.

5. A hull according to claim 1, characterized in that said sides of the rear hull part are tapered downward taken in direction fore to aft.

6. A hull according to claim 1, wherein each of said chines is generally V-shaped with an angle between sides thereof that increases from the stern to the midship cross section.

7. A hull according to claim 6, wherein the angle between the sides of said chines increases to about 45° at the midship cross section.

8. A hull according to claim 1, wherein an angle between said keel and interior sides of said chines increases from the stern to the midship cross section.

9. A hull according to claim 8, wherein the angle between said keel and an interior side of said chines is about 90° at the stern and about 45° at the midship cross section.

10. A hull of a ship having a midship cross section on the waterline that divides the hull into a front hull part, including a central keel, and a rear hull part, having sides provided with chines with a determined maximum depth and extending according to a side hull contour, and a rear hull part bottom which gradually raises from the central keel aft toward the waterline, wherein said front hull part has a deep V-shape contour, with the central keel extending aft gradually downward to a depth greater than said maximum depth of the chines and finally raising in the aft direction, the V-shape of the contour of the front hull part having an angle between the chines gradually increasing from fore to aft to become 180 degrees, said chines, starting from the stern, have a lower edge which is situated under the waterline astern of the midship cross section and then radiused with the front hull part, and said sides of the rear hull part are parallel.

11. A hull of a ship, comprising:

a central keel;

two substantially V-shaped chines depending from opposite sides of the hull aft of a midship cross section, said central keel having a V-shape contour forward of the midship cross section and extending aft gradually downward to a depth greater than a maximum depth of said chines and rising aft of the midship cross section to a depth less than a depth of said chines, wherein the V-shape of the contour of said central keel has an angle between said chines that increases from fore to aft to 180 degrees, wherein a first angle between said central keel and interior sides of said chines increases from the stern to the midship cross section, and wherein each of said chines has a second angle between sides thereof that increases from the stern to the midship cross section.

12. A hull according to claim 11, wherein the second angle between the sides of said chines increases to about 45° at the midship cross section.

13. A hull according to claim 11, wherein the first angle between said central keel and interior sides of said chines is about 90° at the stern and about 45° at the midship cross section.

* * * * *